United States Patent [19]

Reuland

[11] 4,120,194

[45] Oct. 17, 1978

[54] METHOD AND APPARATUS FOR TESTING THE WRAPPERS OF CIGARETTES, FILTER ROD SEGMENTS, AND ANALOGOUS ROD-SHAPED ARTICLES

[75] Inventor: Joachim Reuland, Hamburg, Fed. Rep. of Germany

[73] Assignee: Hauni-Werke Körber & Co. K.G., Fed. Rep. of Germany

[21] Appl. No.: 611,407

[22] Filed: Sep. 8, 1975

[30] Foreign Application Priority Data

Sep. 19, 1974 [DE] Fed. Rep. of Germany ..... 2444708
Nov. 26, 1974 [DE] Fed. Rep. of Germany ..... 2455768

[51] Int. Cl.[2] ..... G01M 3/32
[52] U.S. Cl. ..... 73/45.2
[58] Field of Search ..... 73/41, 45, 45.1, 45.2, 73/1 G, 4 R; 235/151.13; 164/556

[56] References Cited

U.S. PATENT DOCUMENTS

| | | | |
|---|---|---|---|
| 3,030,853 | 4/1962 | Strother | 333/19 X |
| 3,070,988 | 1/1963 | Kapff et al. | 73/1 G |
| 3,412,856 | 11/1968 | Esenwein | 73/45.2 X |
| 3,418,844 | 12/1968 | Wahle | 73/45.1 |
| 3,464,549 | 9/1969 | Armbruster | 235/151.13 X |
| 3,611,790 | 10/1971 | Brouwer et al. | 73/1 G X |
| 3,689,748 | 9/1972 | Bothne | 73/4 R X |
| 3,690,149 | 9/1972 | Pezzi | 73/45.2 X |
| 3,781,652 | 12/1973 | Weaver | 328/150 X |
| 3,862,408 | 1/1975 | Bolt | 235/151.13 X |
| 3,991,605 | 11/1976 | Reuland | 73/45.2 X |

*Primary Examiner*—S. Clement Swisher
*Attorney, Agent, or Firm*—Peter K. Kontler

[57] ABSTRACT

Pneumatic test signals are generated indicative of the extent to which seal imperfections are present in the wrappers of rod-shaped articles, and the pneumatic test signals are converted into electrical test signals. A pneumatic comparison signal is generated and converted into an electrical comparison signal. Signals dependent upon the difference between the electrical comparison and test signals are derived from the electrical comparison and test signals. The determination of whether the wrappers are defective or non-defective includes comparing the derived signals against a reference value.

39 Claims, 15 Drawing Figures

59
51
52
43a
53
54
Z
43b
56
57
58
68
74
83
84
62
61
64
63
66
93
94
96
97
98
99
89
91
92
101
102
103
104
106
107
108
109
67
111
112
113
114
69
71
72
73
116
117

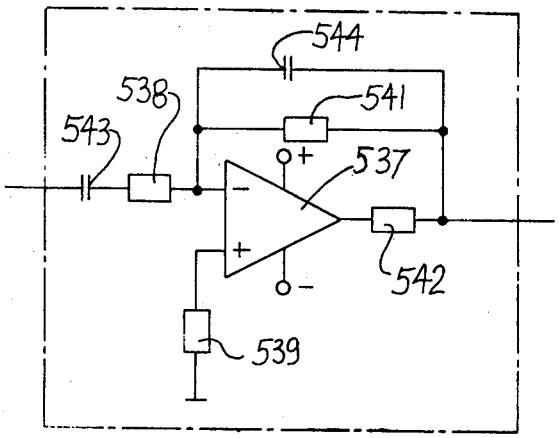
Fig.9
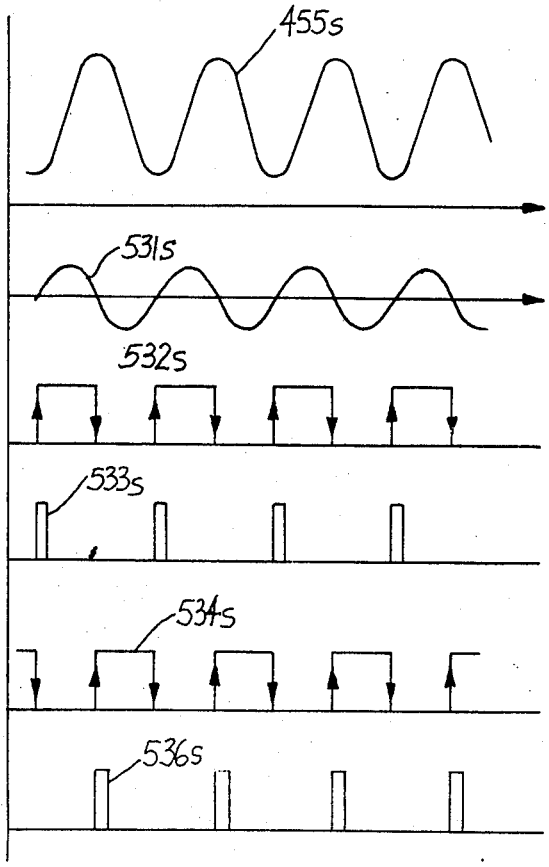
Fig.10a
Fig.10b
Fig.10c
Fig.10d
Fig.10e
Fig.10f

METHOD AND APPARATUS FOR TESTING THE WRAPPERS OF CIGARETTES, FILTER ROD SEGMENTS, AND ANALOGOUS ROD-SHAPED ARTICLES

BACKGROUND OF THE INVENTION

The invention relates to methods of testing the wrappers of rod-shaped articles produced or used in the tobacco-processing industry, particularly methods of a type wherein for example a pressure drop between an interior space surrounded by the wrapper and an exterior space outside the wrapper is created by pneumatic means, and wherein for example for the purpose of generating defect signals pressure changes are detected by converting pneumatic test signals into electrical test signals and then evaluating them.

The invention also relates to arrangements for testing the wrappers of rod-shaped articles produced or used in the tobacco-processing industry, particularly arrangements wherein the articles are transported in a direction transverse to their elongation in recesses of a test conveyor, with the recesses having associated with them sealing means for closing off the front end of the article relative to the environment outside the wrapper. The arrangements in question usually also have means for feeding testing air into the article, to generate between the interior of the article and the exterior of the article a pressure drop, and are further provided with means for detecting testing pressure changes attributable to the permeability of imperfectly formed wrappers, e.g., wrappers having tears, cracks, holes, and the like, with measuring means being provided, the measuring means including for example a measurement value transducer and an evaluating arrangement.

Testing methods and apparatus such as just described produced a test result, for example in the form of a measurement or test signal, which is often erroneous or very inaccurate due to the effect of disturbances, such as atmospheric pressure, humidity and temperature changes, the effect of such atmospheric changes upon mechanical, electromechanical and electronic measurement system components, aging of such components, and the like. The erroneous or very inaccurate measurement or test signals could prevent the testing arrangement from recognizing defective articles as such, or alternatively could cause the testing arrangement to automatically discard articles which are in fact non-defective.

Two particularly important disturbances are disturbances of the pneumatic part of the testing system and fluctuations of the porosity of the wrapper material. Such fluctuations are in general not distinguishable from changes in the total air permeability of the wrapper attributable to structural imperfections of the wrapper.

SUMMARY OF THE INVENTION

It is a general object of the invention to reduce the effect of disturbances upon the pneumatic measuring of the wrappers of rod-shaped articles.

This general object, and others which will become more understandable from the description, below, of preferred embodiments, can be met, according to one advantageous concept of the invention, by generating a definite pneumatic comparison signal and then converting it into an electrical comparison signal. A difference signal between the comparison signal and the wrapper permeability test signal is then formed, and such difference signal, or a signal suitably derived from the difference signal, is compared with a reference signal. The expression "definite pneumatic comparison signal" is to be understood to mean a constant comparison pressure.

The effect of disturbances can be optimally reduced, according to another concept of the invention, by forming each comparison signal intermediate the formation of two successive test signals. A comparison signal can be produced with little expense by generating it in dependence upon atmospheric pressure.

The effect upon the measurement results of wrapper material porosity fluctuations can be taken into account, according to a further concept of the invention, by continually deriving an average value from the difference signals and comparing against a reference signal the extent of deviations of the difference signals from the average of a plurality of difference signals.

The average value continually formed from the difference signals can be interpreted as a signal indicative of that component of the total air permeability of the cigarette wrappers specifically attributable to the porosity of the wrapper material itself, i.e., in contrast to that component of the total permeability of the cigarette wrappers specifically attributable to structural defects in the wrappers, such as holes, tears, cracks, and the like.

If defective wrappers appear relatively frequently, then to assure that the aforementioned average value is as accurately indicative of the wrapper material porosity as possible, the difference signals derived from cigarettes having defective wrappers are excluded from the averaging operation.

In order to assure that a wrapper material porosity signal (average value signal) is available immediately upon resumption of operation of the testing apparatus, for example after a considerable period of non-operation, the signal representing the average value advantageously has a duration independent of its generation; for example, it can be an indefinitely persisting signal.

Gradually increasing defectiveness of successively tested wrappers could cause the aforementioned average value to become erroneous or very inaccurate. For example, if the cutting arrangement of the machine producing the rod-shaped articles becomes blunt, then the cut surfaces (front surfaces) of the articles will become increasingly rough, making the sealing-off of the front surface during the pneumatic testing less and less perfect. In order to be able to detect gradually developing defects, the invention contemplates comparing the average value against a reference value.

The expedient of indefinitely storing the average value during an interruption of the testing operation, so that the average value will be immediately available upon resumption, can be dispensed with; instead, the aforementioned difference signals can be transmitted without delay to the averaging device used to determine the average value, but with the comparison of the individual measurement values against the average value being performed only after a predetermined delay. Such delay allows time enough for a useful average value to be formed from a plurality of individual measurement values.

The testing method is well suited for testing during the transport of rod-shaped articles in a direction transverse to their elongation. Defect signals can then be formed in dependence upon comparisons against the reference signal, with the defect signals causing the associated articles, the ones having defective wrappers, to be removed from the conveyor of the articles.

Another cause of erroneous or inaccurate measurement results can be the detection of the measurement value at not exactly the right moment, e.g., at a moment when the cigarette to be tested is not at exactly the correct position relative to the pneumatic measuring means. It is already known to deal with this problem by employing electromechanical synchronizers, for generating synchronizing signals at the proper moments. However, these are relatively expensive and not absolutely accurate; high accuracy is necessary in order to assure that at each and every measurement moment the article being measured will be located at exactly a predetermined location relative to the pneumatic measuring means.

Drift phenomena attributable to the use of such inaccurate synchronizers should also be eliminated. This can be accomplished, according to another advantageous concept of the invention, by combining the test and comparison signals into a continuous signal flow, with the test and measurement signals forming extreme values in the signal flow. The moment at which one of the two signals reaches an extreme value can be detected, and the transmission of the signal for further processing can be made to occur at exactly such moment. This can be accomplished by forming the first derivative (with respect to time) of the signal in question, with a control signal generated in dependence upon the detection of the extreme value being employed to determine the moment at which the original signal in the signal flow should be transmitted for evaluation. This expedient obviates the need for conventional electromechanical synchronizers. Instead, the measurement arrangement itself controls the measurement moments; i.e., the moments at which the measurements are to be performed, or the measurement values transmitted for evaluation can be determined from the test or measurement signal itself.

Accurate detection of the moment at which an extreme value is reached in a signal waveform can be accomplished by continuously differentiating the signal flow and determining when a certain value in the differentiated signal flow is reached. "Differentiating" in this context refers to the performance of the mathematical derivative computation, i.e., forming the first derivative of the signal flow with respect to time. As is well known, formation of the first derivative with respect to time of a curve makes possible the determination of the slope of the curve at any point. If a curve has a maximum or a minimum at a particular point the slope of the curve at such point will be zero. The zero crossover points of the differentiated measurement signals can be inexpensively and easily detected by electronic means. This makes it possible and practical to generate highly accurate and reliable control signals by means of a derivative configuration, for use in evaluating the continually changing measurement signal generated in pneumatic measurement procedures. A comparison signal can for example be generated using a phantom (a specially designed "perfect" or reference article) so designed that the pneumatic testing arrangement generates a comparison signal constituting a reference value for the cigarettes to be tested. During the next-following operating cycle--i.e., until the pneumatic testing arrangement, in order to form a comparison signal, detects the next phantom or the same phantom again, indirectly by detecting the extreme value in the signal flow-- it need only be determined whether during this time interval the reference value is reached, it being possible to do this for example using a comparator. However, it is simpler to form the comparison signal in dependence upon the atmospheric pressure.

In view of the high output (productivity) of modern cigarette- and filter-making machines, the time available between the testing of successive articles for the formation of a pneumatic comparison signal is very short. However, it is important that this comparison signal be transmitted for further processing at exactly the proper moment. To this end it is proposed to detect the moment at which the comparison signal reaches its extreme value. With highoutput cigarette or filter-making machines the time available for testing an individual article is likewise very short, so that likewise the transmission of the measurement signal must be performed at a well-defined and accurately determinable moment. To this end, according to a further concept of the invention, the moment at which the test signal reaches its extreme value is detected, and at that moment the test signal is transmitted for further processing. It is possible to distinguish between the test signals and the measurement signals in a very simple way by associating them with distinguishable extreme values in the signal flow. This would be the case, for example, when the comparison signal, as already explained, is formed in dependence upon the atmospheric pressure.

The inventive apparatus, serving particularly for the practice of the inventive method, is characterized by the provision of a comparison pressure generator associated with the measurement value transducer, the comparison pressure generator being operative for applying to the measurement value transducer a definite comparison pressure. The evaluating arrangement for evaluating signals derived from the measurements comprises a first comparing arrangement connected with the measurement value transducer for generating a signal (difference signal) corresponding to he difference between the testing pressure and the comparison pressure.

It is possible to counteract even extremely slight drift of the measurement signal by providing a control means operative for connecting the measurement value transducer alternatively to the articles to be tested and to the comparison pressure generator.

If atmospheric pressure is employed for the comparison pressure, then the comparison pressure generator will have the extremely simple form of a controllable opening which can be made to communicate with the atmosphere.

The inventive expedients are particularly well suited for use when the measurement value transducer has the form of a pressure-to-voltage converter.

To take into account wrapper material porosity fluctuations, the invention further contemplates connecting an averaging device to the output of the first comparing arrangement. The averaging device is connected with a second comparing arrangement which is likewise connected with the first comparing arrangement.

According to one concept of the invention, the second comparing arrangement is connected at its input with the first comparing arrangement and with the averaging device, and is connected at its output with the averaging device. The transmission of signals derived from defective articles to the averaging device is positively prevented; the second comparing arrangement is connected with a comparator connected with a control arrangement which is designed to control the transmission of signals from the second comparing arrangement to the averaging device.

The effect of gradually developing wrapper structural defects upon the average value can be detected by connecting the averaging device to a comparator.

In order that it be possible to take the wrapper material porosity into account immediately upon a resumption of testing, i.e., after an interruption in the testing, the invention contemplates providing the averaging device with means for generating an indefinitely persisting output signal. This output signal is controlled in dependence upon the wrapper material porosity fluctuations, the signal generator for the indefinitely persisting output signal being an adjustable signal generator and being controlled by an adjusting motor in turn controlled by the averaging device and an intermediate evaluating arrangement.

According to a further concept of the invention, the first comparing arrangement is connected via a time delay arrangement with the second comparing arrangement, so that at the start of testing there will be time enough before the comparison is performed for a usable average value to be formed.

To avoid drift phenomena introduced by electromechanical synchronizers, the invention contemplates providing the evaluating circuit with a circuit arrangement connected with the measurement value transducer for receiving a signal flow constituted by the test and comparison signals. The test and comparison signals form the extreme values in this signal flow, and the aforementioned circuit arrangement is operative for detecting the moment when one of the two signals reaches an extreme value, and it is connected with the evaluating circuit and designed to generate a control signal at the moment in question, with the control signal effecting the transmission of the corresponding signal to the evaluating arrangement. A circuit arrangement particularly well adapted for this purpose comprises a differentiator stage and a threshold stage. The circuit arrangement can comprise either means for detecting the extreme values of the comparison signals or means for detecting the extreme values of the test signals, or both.

The novel features which are considered as characteristic of the invention are set forth in particular in the appended claims. The apparatus itself, however, both as to its construction and its mode of operation, together with additional features and advantages thereof, will be best understood from the following description of certain specific embodiments when read in connection with the accompanying drawing.

BRIEF DESCRIPTION OF THE DRAWING

FIG. 9 depicts an exemplary circuit for a differentiator; and

FIGS. 10*a*–10*f* depict the output-signal curves of certain circuit elements in the set-up of FIG. 5.

DESCRIPTION OF THE PREFERRED EMBODIMENTS

Figure 1:
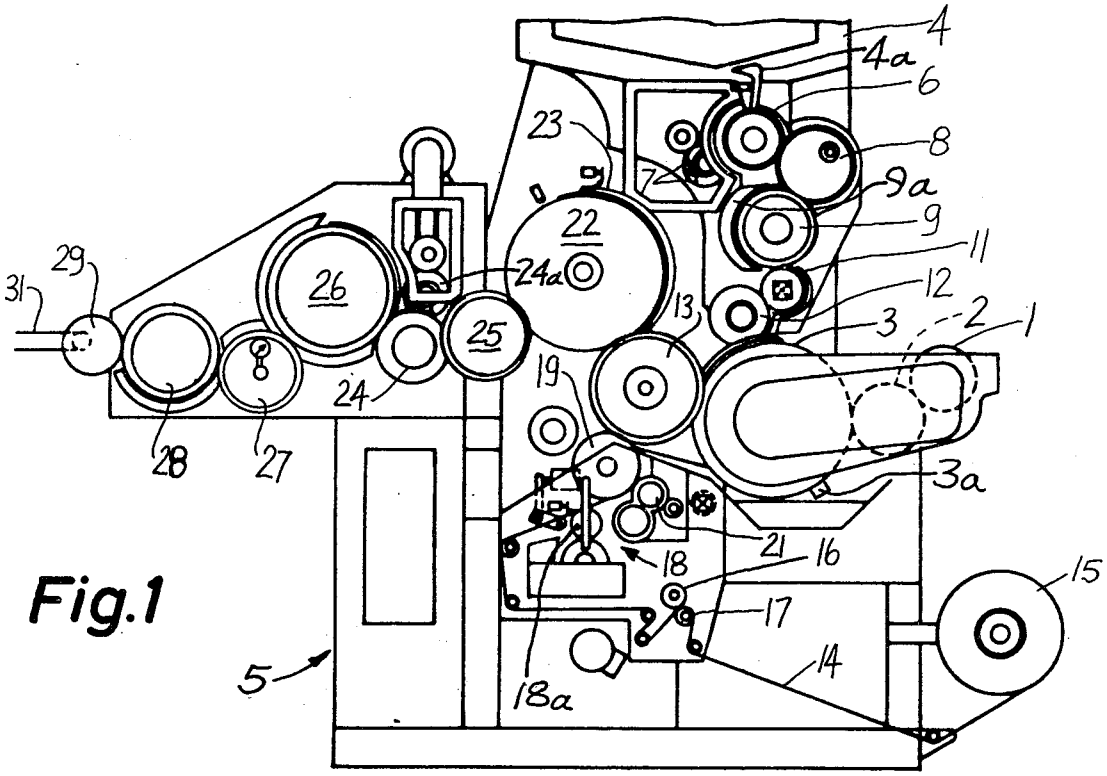
FIG. 1 schematically depicts a machine for producing filter cigarettes, including the test drum of the machine.

FIG. 1 shows a filter cigarette making machine of the type known as MAX (trademark) produced by Hauni-Werke, Körber & Co. K.G., of Hamburg-Bergedorf, Western Germany. The machine is assumed to be directly coupled with a cigarette rod making machine which supplies plain cigarettes of unit length into successive flutes of a rotary drum-shaped row forming conveyor 1 shown in the right-hand portion of FIG. 1. The plain cigarettes in the flutes of the drum 1 form two discrete rows, i.e., the cigarettes in evenly numbered flutes form one row and are nearer to one axial end of the conveyor 1 and the cigarettes in oddly numbered flutes form the other row and are nearer to the other axial end of the conveyor 1.

The frame 5 of the filter cigarette making machine supports two coaxial rotary drum-shaped aligning conveyors 2 (only one shown) each of which receives a row of cigarettes from the conveyor 1. The aligning conveyors 2 are driven at different speeds and/or transport plain cigarettes of the respective rows through different distances so that each cigarette of one row is aligned with a cigarette of the other row before the conveyors 2 transfer cigarettes into successive flutes of a rotary drum-shaped assembly conveyor 3. The plain cigarettes of each pair of cigarettes in a flute of the assembly conveyor 3 are spaced apart so that they define a gap having a width which at least equals but normally exceeds the length of a filter rod section of double unit length.

The frame 5 supports a magazine or hopper 4 which contains a supply of parallel filter rod sections of six times unit length. A single row of filter rod sections leaves the magazine 4 by way of a downwardly inclined duct 4a which feeds the sections into successive flutes of a rotary drum-shaped severing conveyor 6 cooperating with two rapidly rotating disk-shaped knives 7 to subdivide each filter rod section of six times unit length into a group of three coaxial filter rod sections of double unit length.

The conveyor 6 delivers filter rod sections of double unit length into the flutes of three discrete rotary drum-shaped staggering conveyors 8 (only one shown) so that each conveyor 8 receives one section of a group. The conveyors 8 are driven at different speeds and/or transport the respective filter rod sections through different distances so as to stagger the sections of successive groups, as considered in the circumferential direction of the illustrated conveyor 8. The conveyors 8 deliver the thus staggered sections of double unit length into successive flutes of a rotary drum-shaped shuffling conveyor 9 which cooperates with stationary cams 9a to shift one or more sections in the flutes of the conveyor 9 axially and to form a single row of accurately aligned sections of double unit length wherein each preceding section is in exact register with the next-following section.

The shuffling conveyor 9 delivers successive sections of the thus obtained row into successive flutes of a rotary drum-shaped transfer conveyor 11 which, in turn, delivers successive sections into successive flutes of a rotary drumshaped accelerating conveyor 12 serving to insert filter rod sections of double unit length into the gaps between pairs of coaxial plain cigarettes of unit length in successive flutes of the assembly conveyor 3. Thus, once a flute of the assembly conveyor 3 advances beyond the transfer station between the conveyors 3 and 2, it contains a group of three coaxial rod-shaped articles including two spaced-apart plain cigarettes of unit length and a filter rod section of double unit length therebetween. The conveyor 3 transports such groups past two stationary cams 3*a* which cause one or both plain cigarettes of each group to move axially toward the other cigarette of the same group so that the inner end faces of the cigarettes abut against the respective end faces of the filter rod section therebetween. The conveyor 3 thereupon introduces successive condensed groups into successive flutes of a rotary drum-shaped transfer conveyor 13 which is adjacent to a rotary suction drum 19.

The frame 5 supports a bobbin 15 containing a supply of cigarette paper web, imitation cork web or an analogous web 14 which is being withdrawn by two advancing rolls 16, 17 and whose leader is attracted to the periphery of the suction drum 19. The web 14 travels along and one of its sides contacts a rotary applicator 18*a* forming part of a paster 18. The latter further includes a tank and a roller which dips into the tank and applies a film of adhesive paste to the periphery of the applicator 18*a*. The suction drum 19 cooperates with a rotary knife 21 to sever the leader of the web 14 at regular intervals and to thus form a succession of adhesive-coated uniting bands which are attached to successive groups in the flutes of the transfer conveyor 13 in such a way that each uniting band extends tangentially of the respective group and contacts the filter rod section of double unit length as well as the adjacent inner end portions of the corresponding plain cigarettes.

The transfer conveyor 13 delivers successive groups (each such group consists of two plain cigarettes, a filter rod section of double unit length and an adhesive-coated uniting band) to a rotary wrapping conveyor 22 which cooperates with a stationary or mobile rolling device 23 so as to cause successive groups to rotate about their respective axes and to thereby convert the respective uniting bands into tubes which surround the corresponding filter rod sections and the adjacent inner end portions of associated plain cigarettes. Thus, each group which advances beyond the rolling device 23 constitutes a filter cigarette of double unit length.

The wrapping conveyor 22 delivers successive filter cigarettes of double unit length into successive flutes of a rotary drum-shaped transfer conveyor 25 which supplies the cigarettes to the flutes of a severing conveyor 24 cooperating with a rotary disk-shaped knife 24a to sever each filter cigarette of double unit length midway between its ends so that each such cigarette yields two coaxial filter cigarettes Z of unit length. Filter cigarettes Z of unit length are shown in FIGS. 2, 3 and 5 to 8.

The severing conveyor 24 delivers pairs of filter cigarettes Z to a turn-around device 26 of known design which inverts one cigarette Z of each pair end-for-end and places it into the space between two adjoining non-inverted cigarettes so that all of the cigarettes Z form a single row and the filter tips of all cigarettes face in the same direction. The inverting device 26 delivers the cigarettes Z of the thus obtained single row into successive flutes of a rotary drum-shaped conveyor 27 forming part of a first cigarette testing apparatus. This testing apparatus examines the wrappers of cigarettes Z for the presence or absence of holes, open seams, cracks and/or other defects and includes means for producing signals which are utilized to segregate satisfactory cigarettes from cigarettes having defective wrappers. The conveyor 27 delivers the cigarettes Z (or at least the satisfactory cigarettes Z) into successive flutes of a rotary drum-shaped conveyor 28 forming part of a second testing apparatus which examines the tobacco-containing ends of successive cigarettes Z and includes means for generating signals which are indicative of cigarettes with unsatisfactorily (too soft) tobacco-containing ends. The conveyor 28 delivers the cigarettes Z (or at least those cigarettes whose tobacco-containing ends are satisfactory) into successive flutes of a rotary drum-shaped transfer conveyor 29 which delivers the cigarettes onto the upper stretch of an endless take-off belt conveyor 31. The latter can deliver cigarettes Z to storage, to a tray filling apparatus, or directly into a packing machine, not shown.

The ejection or segregation of cigarettes Z whose wrappers are defective can take place before the defective cigarettes reach the conveyor 28, during travel with the conveyor 28, or during travel with the conveyor 29. If desired, the cigarettes Z having defective wrappers can be segregated simultaneously with cigarettes having defective tobacco-containing ends. The means for ejecting may comprise one or more nozzles for compressed air which are adjacent to a predetermined portion of the path of movement of successive cigarettes Z and permit a blast of compressed air to expel a defective cigarette Z (by moving the cigarette axially or radially of the respective rotary conveyor) at the exact moment when the defective cigarette is located in the afore mentioned portion of its path.

Figure 2:
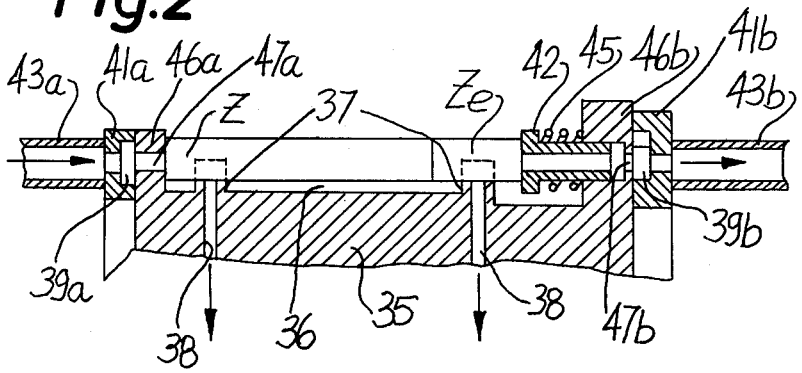
FIG. 2 is a partial sectional view of the test drum.
Figure 3:
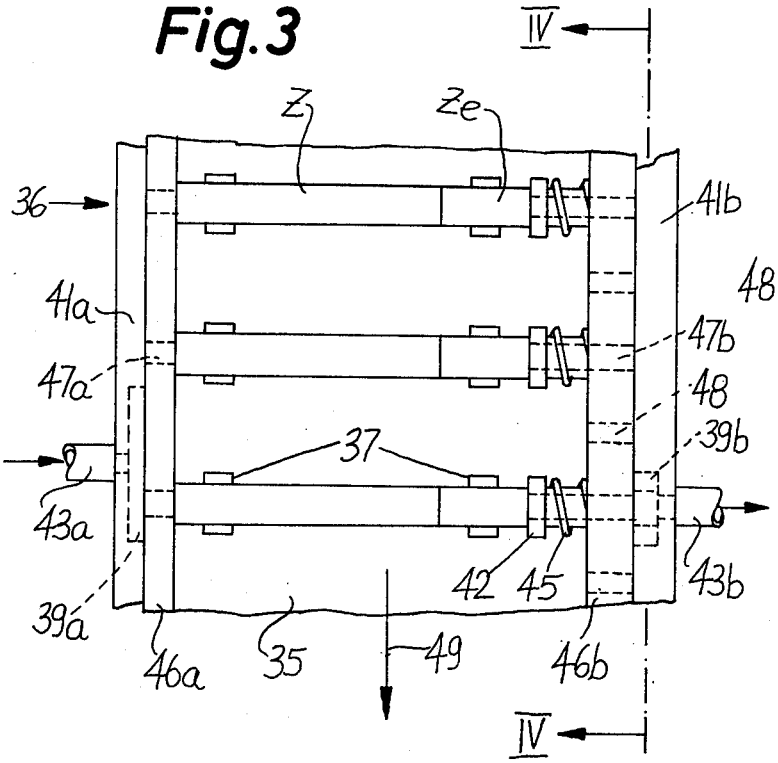
FIG. 3 is a developed view of a part of the test drum.
Figure 4:
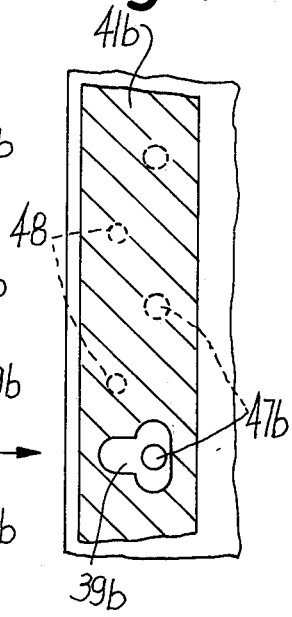
FIG. 4 is a section taken on line IV-IV of FIG. 3.

Details of the test drum 27 are shown in FIGS. 2–4. A drum body 35 which is driven for rotation is provided with recesses 36 for the cigarettes Z. The cigarettes Z are supported on members 37 provided with internal suction conduits 38 for holding the cigarettes in place. The suction conduits 38 are connected via a (non-illustrated) stationary control ring to a source of suction. By means of control slits 39*a*, 39*b* in stationary control rings or valve plates 41*a*, 41*b*, and by means of a sealing member 42, the cigarettes Z can be filled with pressurized test gas supplied via the conduit 43*a*. The sealing member 42 can be pushed by a (non-illustrated) conventional mechanical control device, for example a cam control device, into place against the filter ends Ze of the cigarettes Z against the force of biasing springs 45. Flanges 46*a*, 46*b* on the drum body 35 are provided with conduits 47*a*, 47*b* which are lined up with recesses 36 and cooperate with the control slits 39*a*, 39*b*. The control slit 39*a* corresponds in its length to approximately the spacing between the recesses 36, whereas the control slit 39*b* is approximately half as long as the control slit 39*a*. In the flange 46*b*, the conduits 47*b* alternate with conduits 48 which serve to generate comparison pressure and intermittently connect the control slit 39*b* with the atmosphere as the drum body 35 turns in the direction of arrow 49.

When a conduit 47*a* reaches the control slit 39*a*, testing air flows into the interior of the filter cigarette Z, as a result of which the cigarette is "blown up", because the conduit 47*b* is still closed by the control ring 41*b*. When the conduit 47*b* reaches the control slit 39*b*, the preceding conduit 48 will have already passed the control slit, so that now the testing air can flow out of the cigarette Z into the control slit 39*b* and the conduit 43*b*. Accordingly, the control slit 39*b* and the conduits 47*b* and 48 constitute a control means for alternately connecting the conduit 43*b*, which leads in a manner described below to a measurement value transducer, with the cigarettes and with the atmosphere.

Figure 5:
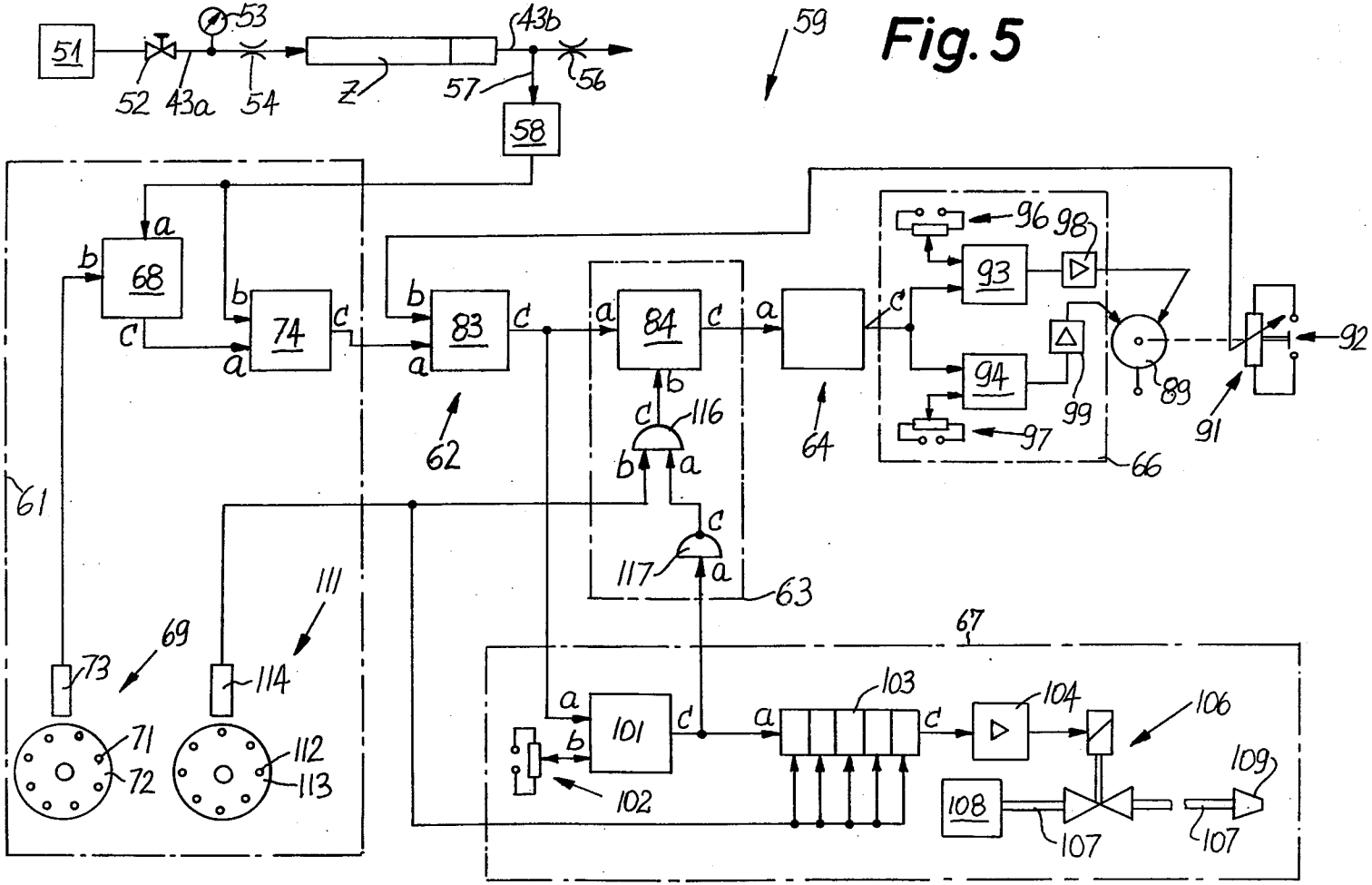
FIG. 5 depicts a testing set-up for detecting seal imperfections in the wrapper of a cigarette.

FIG. 5 depicts a testing set-up. A pressure source 51 is connected to the cigarette Z via conduit 43*a* which contains an adjusting valve 52, a manometer 53 and a flow restrictor 54. Conduit 43*b* contains a flow restrictor 56, upstream of which a branch 57 leads off to a measurement value transducer having the form of a pressure-to-voltage converter (diaphragm transducer) 58. Transducer 58 converts the testing pressure into an electrical voltage, thereby generating an electrical signal corresponding to the air permeablility of a filter cigarette Z. Details of such a testing arrangement are known and disclosed for example in Federal Republic of Germany Pat. No. 1,300,458 and in corresponding U.S. Pat. No. 3,412,856. An evaluating arrangement 59 comprises a first comparator 61, a second comparator 62, a control arrangement 63, an averaging device 64 provided with an evaluating circuit 66, and a control circuit 67 for ejecting defective articles.

The first comparator 61 generates a difference signal corresponding to the difference between a test signal dependent upon the permeability of the cigarette wrapper, on the one hand, and, on the other hand, a comparison signal independent of the cigarette wrapper permeability. The comparator 61 comprises an analog storage device 68 (at its simplest, an RC-circuit). The analog storage device 68 acts for example like a sample-and-hold circuit and stores a signal transmitted to it until it is caused to register the next signal. An input *a* of the analog storage device 68 is connected with the pressure-to-voltage converter 58, whereas its input *b* constitutes the sample-signal input for controlling the sampling and holding action. The sample-signal input *b* of device 68 receives sample signals from a synchronizer 69 comprising a synchronizer disk 72 having synchronizing portions 71 and a cooperating proximity detector 73. The synchronizer disk 72 is so synchronized with the drive for the machine that the cooperating proximity detector 73 generates a synchronizing signal whenever the control slit 39*b* of the testing drum 27 is connected via conduit 48 to the atmosphere. A comparison signal is generated at each such moment and is registered by the analog storage device 68. The comparison signal is independent of the cigarettes Z. The output *c* of analog storage device 68 is connected to input *a* of a subtracting device 74 for transmitting the registered signal thereto. The other input *b* of the subtracting device 74 is connected to the output of the pressure-to-voltage converter 58. Output *c* of subtracting device 74 is connected with input *a* of a difference amplifier 83 which serves as the second comparator 62. Ouput *c* of difference amplifier 83 is connected with input *a* of a controllable storage 84 (a sample-and-hold amplifier, such as manufactured by the National Semiconductor Corporation under the designation LH 00 23). The controllable storage 84 forms part of the control arrangement 63 for preventing the transmission of signals derived from cigarettes having defective wrappers.

A signal dependent upon the porosity of the wrapper material of the cigarette Z is generated by means of an arrangement comprises the averaging device 64 (for example a one-resistor, one-capacitor low-pass filter), the evaluating circuit 66, an adjusting motor 89 and an adjustable signal generator 91 supplied by a voltage source 92. The combination of the adjusting motor 89 and the adjustable signal generator 91 is commercially available as a single unit known as a "Motorpotentiometer". It is manufactured for example by the Megatron Corporation of Munich, Federal Republic of Germany and comprises a D.C. motor type 15255, a transmission type FMM 15 and a rotary potentiometer type AL 2510.

Input *a* of averaging device 64 is connected to the output *c* of the controllable storage 84, whereas its output *c* is connected to the input of evaluating circuit 66. Evaluating circuit 66 comprises two comparators 93, 94 (such as type LM 311 made by the National Semiconductor Corporation), each provided with a respective reference-signal generator 96 or 97 and a respective power amplifier 98 or 99. The comparator 93 generates an output signal when the output signal of averaging device 64 exceeds a certain positive value (e.g., +1 volt), whereas the comparator 94 generates an output signal when the output signal of the averaging device 64 falls below a certain negative value (e.g., −1 volt). In the first case, the adjusting motor 89 effects an adjustment of signal generator 91 such as to increase the output voltage of the latter; in the second case, the adjusting motor 89 effects an adjustment of the signal generator 91 such as to decrease the output voltage of the latter. The adjustment occurs relatively slowly; for example, use can be made of an intermediate speed-reducing transmission having a high input/output speed ratio.

The output of signal generator 91 is connected to input *b* of difference amplifier 83. Output *c* of difference amplifier 83 is connected with input *a* of a comparator 101 of the control circuit 67. The second input *b* of comparator 101 is connected to a reference-signal generator 102 serving to determine the maximum permissible air permeability of a cigarette in the testing station. Output *c* of comparator 101 is connected with input *a* of a shift register 103, the output *c* which is connected via a power amplifier 104 with an electromagnet-controlled valve 106 located in a conduit 107 which connects a source of pressurized air 108 to an ejection nozzle 109. The ejection nozzle 109 can for example be so arranged relative to the path of travel of cigarettes on the test conveyor 27 that the number of shift-register stages corresponds to the distance between the testing location and the ejection location. Signals are transmitted through the successive shift register stages under the control of a synchronizer 111 comprising synchronizer disk 113 provided with synchronizing portions 112 and a cooperating proximity detector 114. The synchronizing disk 113 is synchronized with the drive for the machine in such a manner that the proximity detector 114 generates a control (shift) signal each time a cigarette is being tested, i.e., each time the control slit 39*b* is connected with the interior of a cigarette Z via conduit 47*b*.

The transmission control arrangement 63, besides the controllable storage 84, includes an AND-gate 116 and a NOT-gate or inverter 117. The input *a* of the inverter 117 is connected with output *c* of comparator 101, whereas its output *e* is connected with input *a* of AND-gate 116. The second input *b* of AND-gate 116 is connected to the output of the proximity detector 114 of the synchronizer 111. Output *c* of AND-gate 116 is connected to sample-signal input *b* of controllable storage 84.

The operation of the arrangement shown in FIGS. 2–5 is as follows:

Testing pressure and comparison pressure are alternately applied to the pressure-to-voltage converter 58, specifically each time that a conduit 47*b* or a conduit 48, respectively, becomes connected with the conduit 43b via the control slit 39b. In the first case, testing air flows from the pressure source 51 via the conduit 43a, the control slit 39a, through a cigarette Z, through the conduit 47b and the control slit 39b into the conduit 43b; in the second case, the conduit 43b is connected to the atmosphere via the control slit 39b and the conduit 48.

An electrical comparison signal is transmitted to input *a* of analog storage device 68, under the control of synchronizer 69, from the analog pressure-to-voltage converter 58 each time the conduit 43b is connected with the atmosphere; on the other hand, the difference signal continually generated at the output *c* of subtracting device 74 is transmitted for evaluation, by means of the synchronizer 111 and the transmission control arrangement 63 or the shift register 103, each time the conduit 43b is filled with test air passing through a cigarette Z. The formation of the difference between the test signal and the comparison signal, because both signals are generated using the same pressure-to-voltage converter 58, serves to suppress the effect of drift phenomena in the pneumatic measuring system and in the measurement transducer; disturbances producing these drift phenomena will not affect the results of the measurements, or will affect them to a negligible degree.

The arrangement of FIGS. 2–5 is furthermore capable of taking into account the effect of wrapper material porosity fluctuations which, to a limited extent, are permissible in the cigarettes, when evaluating the test signals. This is accomplished as follows:

Before setting the arrangement into operation for the very first time, the adjustable signal generator 91 is manually adjusted to a voltage setting corresponding to a normally prevailing average wrapper material porosity value. This manual adjustment is necessary only the first time the arrangement is set into operation. Thereafter, whatever setting has previously been established by automatic means can in general be used, even after a prolonged interruption of operation, because the signal (i.e., the potentiometer wiper setting) is a persisting signal.

The difference signal from the subtracting device 74 is compared by the difference amplifier 83 against the signals from the signal generator 91. If the two compared signals are different, the difference amplifier 83 applies a signal corresponding to such difference to the controllable storage 84 and also to the comparator 101. The comparator 101 determines whether this signal falls below the reference value established by reference-signal generator 102. If this is in fact the case, then the pressure measured by the pressure-to-voltage converter 58 was too low, i.e., so much test air escaped through the wrapper of the cigarette Z in question as to indicate that the cigarette was defective. In such event, the comparator 101 applies a defect signal to shift register 103. As shifting pulses are supplied to the shift register 103 from synchronizer 111, the defect signal passes through the successive shift-register stages in simulation of the travel of the cigarette in question from the testing location to the ejection location. By the time the cigarette in question has reached the ejection location, the associated defect signal will have been applied via power amplifier 104 to the electromagnet-controlled valve 106, permitting pressurized air from pressure source 108 to travel through conduit 107 and emerge from ejection nozzle 109 as a blast effecting ejection of the defective cigarette from the testing drum 27.

The output signal of comparator 101 is applied to the input *a* of NOT-gate or inverter 117 and from the output *c* thereof in inverted condition (i.e., as a "0" signal) to input *a* of AND-gate 116. Consequently, although synchronizer 101 applies a synchronizing pulse to input *b* of AND-gate 116, the AND-gate 116 does not apply a sample signal to control input *b* of controllable storage 84. As a result, the wrapper permeability signal at the output *c* of difference amplifier 83 is not transmitted by controllable storage 84 to averaging device 64. Instead, the storage 84 continues to transmit to the averaging device 64 the difference-amplifier output signal associated with the last non-defective cigarette Z.

Porosity fluctuations in the wrapper material of the cigarettes are in general gradual, so that for a series of non-defective cigarettes Z the changes in the signals generated by pressure-to-voltage converter 58 attributable to such fluctuations are relatively small. Even in the case of a change of the wrapper material supply bobbin, which may involve a relatively abrupt change in the wrapper material porosity, the wrapper material porosity change is in general still below the limit associated with defective cigarettes. However, such limit can be reached over a certain period of time if the wrapper material porosity gradually but continually changes. However, as already indicated, the signal changes resulting from wrapper material porosity fluctuations in a series of non-defective cigarettes are in general relatively small, so that the output signal of difference amplifier 83 in general will not fall below the reference signal applied to comparator 101 by reference-signal generator 102, and the comparator 101 will not generate an output signal (a logical "1").

If the wrapper material porosity decreases, resulting in an increase of the test signal, this will never cause the output signal of difference amplifier 83 to fall below the reference signal supplied by reference-signal generator 102; i.e., a wrapper material porosity decrease, in the case of otherwise non-defective cigarettes, does not cause the comparator 101 to generate an output signal (a logical "1"). Thus, normally, no signal will be applied to the input *a* of NOT-gate 117, so that NOT-gate 117 will apply a signal to input *a* of AND-gate 116. When the AND-gate 116 receives at input *b* thereof a signal from synchronizer 111, the AND-gate 116 applies a signal to controllable storage 84. This causes the positive or negative difference signal from the output of difference amplifier 83 to be applied to the averaging device 64 for the duration of a period, i.e., the time between successive synchronizing signals from synchronizer 111.

The averaging device 64 operates relatively sluggishly, so that its output signal changes only slowly in response to wrapper material porosity fluctuations. Let it be assumed that the wrapper material porosity increases. As a result, the difference between the signal from subtracting device 74 and the signal from adjustable signal generator 91 results in the generation of a negative output signal at the output *c* of difference amplifier 83. If the wrapper material porosity remains at the increased value, a series of such negative difference-amplifier output signals will be generated and applied to the averaging device 64. As a result, the averaging-device output signal will go increasingly negative. If this output signal falls below the reference signal applied by reference-signal generator 97 to comparator 94, the latter generates an output signal which is applied via the associated power amplifier 99 to the adjusting motor 89. The adjusting motor 89 effects a gradual adjustment of the adjustable signal generator 91 in a sense causing the output signal of signal generator 91 to decrease. This decrease of the output signal of signal generator 91 causes the difference between the input signals applied to difference amplifier 83 to decrease; i.e., the change of the output signal of difference amplifier 83 resulting from a wrapper material porosity change is gradually offset by a like-sign change in the signal applied to input *b* of difference amplifier 83 by adjustable signal generator 91.

If the wrapper material porosity decreases, the difference amplifier 83 generates a positive output signal, which is then applied by controllable storage 84 to averaging device 64. If the wrapper material porosity remains at the decreased value, a series of such positive signals is applied to averaging device 64, as a result of which the output signal of averaging device 64 goes increasingly positive. If the averaging-device output signal exceeds the reference signal supplied by reference-signal generator 96 to comparator 93, then the latter generates an output signal which is applied via the associated power amplifier 98 to the adjusting motor 89. The adjusting motor 89 will effect an opposite adjustment of the signal generator 91, i.e., in a sense causing the output voltage of signal generator 91 to increase. Here, likewise, the change of the measurement signal resulting from a change (decrease) of the wrapper material porosity is compensated for. Defective filter cigarettes have no effect upon this compensation for wrapper material porosity changes, because the signals derived from defective cigarettes are not transmitted to the averaging device 64.

Instead of determining the wrapper material porosity in effect absolutely and then reducing the measurement signal by the amount of a signal corresponding to the porosity, it would also be possible, by slightly modifying the arrangement, for example by changing the reference values employed, to determine only the relative porosity, i.e., the deviation from an average value, and then correct the measurement signal correspondingly. Also, the measurement expedient disclosed herein is suited not only for pneumatic measurements, but also for analogously performed measurements, for example employing sound waves for testing purposes.

Figure 6:
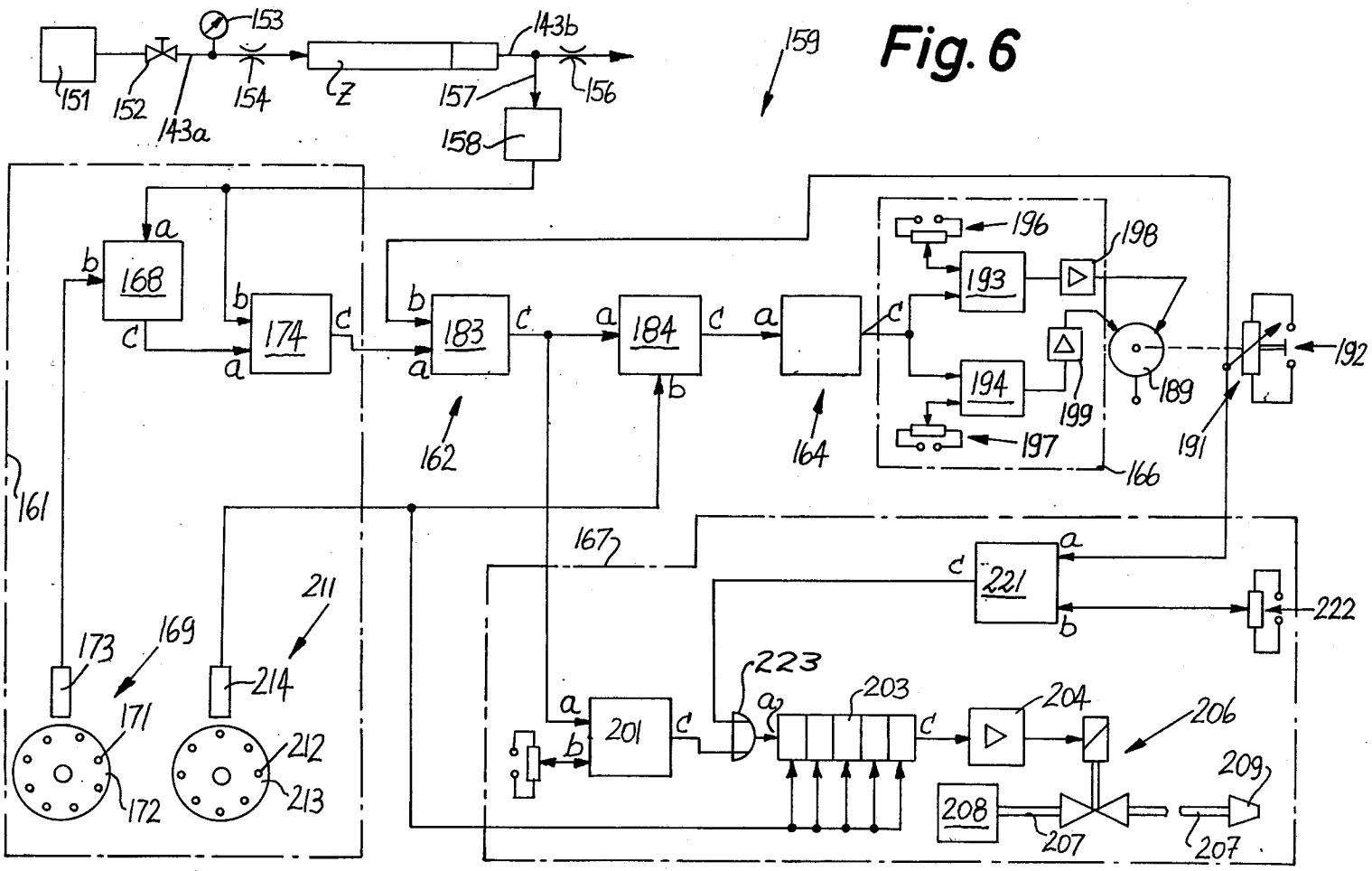
FIG. 6 depicts another testing set-up.

The set-up shown in FIG. 6 is a modification of that shown in FIG. 5. Parts corresponding to those in FIG. 5 are designated by the same reference numerals, increased by 100, and need not be described again.

In contrast to the set-up of FIG. 5, in the set-up of FIG. 6 the proximity detector 214 of the synchronizer 211 is directly connected with input *b* of the controllable storage 184. As a result, difference signals derived from cigarettes having defective wrappers are transmitted to the averaging device 164. However, to make it possible to recognize defective cigarettes as such, the signal generator 191 is connected not only to the difference amplifier 183 but furthermore with a comparator 221 to which is applied a reference signal from a reference-signal generator 222. The comparator 221 generates an output signal when the signal from signal generator 191 falls below the reference signal furnished by reference-signal generator 222. This occurs when a series of defective cigarettes has been tested. In order that such a series of defective cigarettes, on account of the changed average value (signal furnished by signal generator 191), should not be perceived and processed by the arrangement as being non-defective, which could otherwise eventually happen with a long enough series of defective cigarettes, the output signal of comparator 221 is applied as a defect signal to shift register 203, via OR-gate 223, so that defective cigarettes will be ejected.

Figure 7:
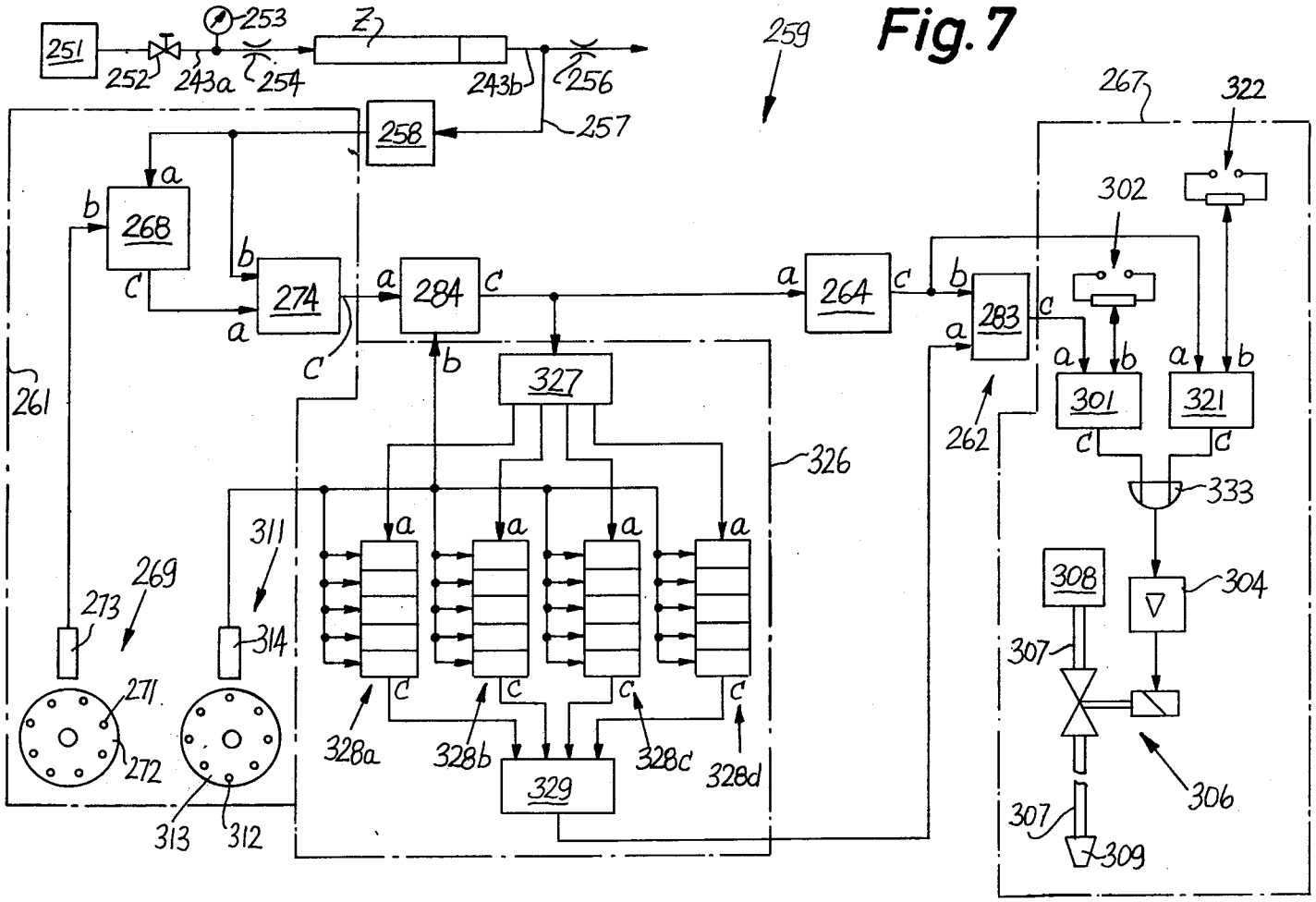
FIG. 7 depicts a further testing set-up.

FIG. 7 depicts a variation of the testing set-up of FIG. 6. Components in FIG. 7 corresponding to those in FIG. 6 are designated by the same reference numerals,, increased by a further 100, and need not be described again.

In FIG. 7, the subtracting device 274 of the first comparator 261 has its output *c* connected via the controllable storage 284 to the input *a* of the averaging device 264. The output *c* of averaging device 264 is in turn connected to the input *b* of the difference amplifier 283 of the second comparator 262. The subtracting device 274 is furthermore connected, via the controllable storage 284 and a delay stage 326, with the difference amplifier 283. The delay stage 326 comprises an analog-to-digital converter 327, four shift registers 328*a*, 328*b*, 328*c*, 328*d* connected to the output of converter 327 and driven by the synchronizer 311, and a digital-to-analog converter 329 connected to the outputs *c* of the shift registers. Such a delay stage, which in isolation is conventional, can be used to transmit analog signals with a machine-speed-dependent time delay. The outputs of averaging device 264 and difference amplifier 283 are again connected to elements of the control circuit 267 in the manner explained with reference to FIG. 6.

In contrast to the set-up of FIG. 6, in the set-up of FIG. 7 the comparison between the average value and the instantaneous value of the tested cigarettes is not performed immediately, with a defect signal, if generated, being transmitted with a time delay; instead, the comparison is not performed until the cigarette in question actually reaches the ejection location. If the machine is being started up, between the moment when the first cigarette is tested and the moment the first cigarette reaches the ejection location, sufficient time will have elapsed for the formation of a usable average signal derived from a plurality of successively tested cigarettes.

Figure 8:
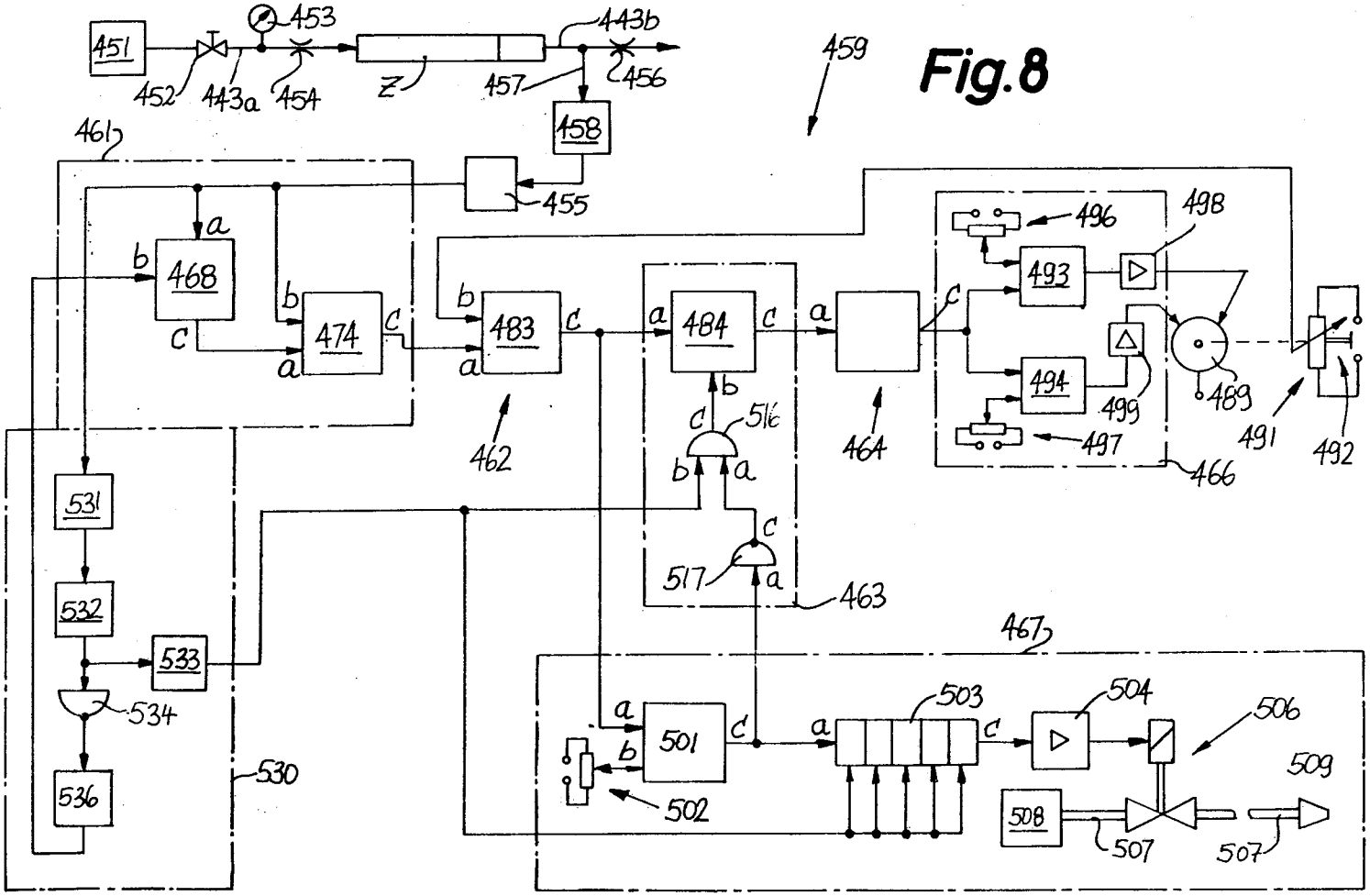
FIG. 8 depicts a variant of the testing set-up of FIG. 5.

In the testing set-up of FIG. 8, parts corresponding to those in FIG. 5 are designated by the same reference numerals, increased by 400, and need not be described again.

In FIG. 8, the pressure-to-voltage converter 458 is a fast-response pressure-to-voltage converter, for example type LX 3702G made by the National Semiconductor Corporation. The set-up of FIG. 8 is particularly well adapted for very high-speed testing, for example for testing cigarettes in cooperation with a very-high-output cigarette making machine. Connected to the output of the pressure-to-voltage converter 458 is a low-pass filter 455 for suppressing noise in the signal flow. FIG. 10*a* depicts the waveform of the output signal of the low-pass filter 455 in the form of a curve 455*s*.

The set-up of FIG. 8 also differs from that of FIG. 5 in that the two synchronizers of FIG. 5 are not used. The synchronizers are replaced by a circuit arrangement 530. Arrangement 530 includes a differentiator 531, a threshold circuit (e.g., Schmitt trigger) 532, a NOT-gate or inverter 534 and two pulse shapers 533 and 536. FIG. 9 depicts an exemplary circuit for the differentiator 531 which comprises an operational amplifier 537 for changing the phase of the input signal, resistors 538–539, 541–542 and capacitors 543 and 544.

The threshold circuit 532 can for example be type LM 301 made by the National Semiconductor Corporation. The pulse shapers 533 and 536 can be monostable multivibrator circuits.

FIGS. 10*b*–10*f* depict curves corresponding to the output signals of the individual circuit components of the circuit arrangement 530, all related to the signal curve 455*s* of FIG. 10*a*. The reference numeral of each circuit component in question, followed by the letter "*s*", is used to identify the corresponding output-signal curve. The curves indicate that the differentiator 531, the threshold circuit 532 and the pulse shaper 533 together constitute means for detecting extreme values (maxima) of the measurement signals, whereas the differentiator 531, threshold circuit 532 and the pulse shaper 536 together constitute means for detecting extreme values (minima) of the comparison signals. Specifically, the pulse shaper 533 generates an output signal at the time when a cigarette is being tested, whereas the pulse shaper 536 generates an output signal at the time when the control slit, in the manner already described with respect to FIGS. 2–4, is connected with the atmosphere. In other respects, the operation of the set-up of FIG. 8 corresponds exactly to that of FIG. 5.

The synchronizers used in the testing set-ups of FIGS. 6 and 7 could likewise be replaced by such a circuit arrangement 530. The particular advantage of the circuit arrangement 530 is that the measurement signal itself (at output of 458) can be used to determine the moments at which the cigarettes are exactly in the desired measuring position and the moments at which the comparison signal is to be detected, so as to determine from the measurement signal itself the proper moment for transmitting the measurement and comparison signals for evaluation. The need for separate electromechanical synchronizers is obviated.

An important advantage of the invention is the marked insensitivity to drift phenomena in the measurement signals. Another important advantage is that it is possible to separate out the effect of wrapper material porosity fluctuations when determining which wrappers are actually defective.

It will be understood that each of the elements described above, or two or more together, may also find a useful application in other types of circuits and constructions differing from the types described above.

While the invention has been illustrated and described as embodied in an apparatus for testing filter cigarettes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of testing the wrappers of cigarettes, cigars, filter rods, analogous rod-shaped smokers' products, components thereof, and the like, comprising the steps of generating pneumatic test signals indicative of the extent to which imperfections are present in the wrappers of such rod-shaped articles and converting the pneumatic test signals into electrical test signals; conveying said test signals along a first path; generating a pneumatic comparison signal and converting said pneumatic comparison signal into an electrical comparison signal; conveying said comparison signals along a second path, at least a portion of one of said paths being common to at least a portion of the other of said paths so that drift phenomena, if any, and not ascertained, which influence the characteristics of said test signals in each common portion of said paths also influence the characteristics of said comparison signals; deriving from the electrical comparison and test signals derived signals dependent upon the difference between the electrical comparison and test signals but uninfluenced by drift phenomena; and determining whether the wrappers are defective or non-defective by comparing the derived signals against a reference value.

2. The method defined in claim 1, wherein the generating of the test signals comprises generating successive test signals corresponding to successive articles, and wherein the generating of the comparison signal comprises generating a comparison signal intermediate the generation of each two successive test signals.

3. The method defined in claim 1, wherein the generating of the comparison signal comprises generating the comparison signal in dependence upon atmospheric pressure.

4. The method defined in claim 1, wherein the step of deriving signals comprises generating difference signals corresponding to the difference between the electrical comparison and test signals, continually forming an average value from the difference signals, and generating as the derived signals signals indicative of the deviations of the difference signals from the average value.

5. The method defined in claim 4, wherein the forming of the average value from the difference signals comprises forming the average value from only those difference signals derived from articles having non-defective wrappers.

6. The method defined in claim 4, wherein the formation of the average value comprises generating a signal indicative of the average value, the signal having a duration independent of its generation.

7. The method defined in claim 4, wherein the step of determining whether the wrappers are defective or non-defective further comprises comparing the average value against a second reference value.

8. The method defined in claim 4, wherein the step of continually forming an average value from the difference signals comprises transmitting the difference signals to an averaging device substantially without any delay, and wherein the step of generating as the derived signals signals indicative of the deviations of the difference signals from the average value comprises comparing each difference signal against the average value only after the elapse of a time delay corresponding to the time required for testing a plurality of successive articles.

9. The method defined in claim 1, the method including transporting the rod-shaped articles in a direction transverse to their elongation during the testing of the articles.

10. The method defined in claim 1, and in dependence upon the comparison of the derived signals against the reference value generating defect signals indicative of which rod-shaped articles have defective wrappers, and using the defect signals to control the operation of a discarding device so as to discard the articles having defective wrappers.

11. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; conveying said test signals along a first path; generating a pneumatic comparison signal and converting said pneumatic comparison signal into an electrical comparison signal; conveying said comparison signals along a second path, at least a portion of one of said paths being common to at least a portion of the other of said paths so that drift phenomena, if any, which influence the characteristics of said test signals in each common portion of said paths also influence the characteristics of said comparison signals, said generating steps including generating said test and comparison signals as the components of a signal flow in which test and comparison signals form extreme values; deriving from said electrical comparison and test signals derived signals dependent upon the difference between said electrical comparison and test signals, comprising processing said comparison and test signals including detecting the moment at which one of the signals reaches an extreme value and at that moment initiating the processing of the one signal; and determining whether the wrappers are defective or non-defective by comparing said derived signals with a reference value.

12. The method defined in claim 11, wherein the detecting of the moment at which one of the signals reaches an extreme value comprises forming the first time derivative of the signal flow and detecting the moment at which the first time derivative reaches a predetermined value.

13. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; conveying said test signals along a first path; generating a pneumatic comparison signal and converting said pneumatic comparison signal into an electrical comparison signal; conveying said comparison signals along a second path, at least a portion of one of said paths being common to at least a portion of the other of said paths so that drift phenomena, if any, which influence the characteristics of said test signals in each common portion of said paths also influence the characteristics of said comparison signals; deriving from said electrical comparison signals and said electrical test signals derived signals dependent upon the difference between said electrical comparison and test signals, comprising processing said comparison and test signals including detecting the moment at which the comparison signal reaches an extreme value and at that moment initiating the processing of the comparison signal; and determining whether the wrappers are defective or non-defective by comparing said derived signals with a reference value.

14. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; conveying said test signals along a first path; generating a pneumatic comparison signal and converting said pneumatic comparison signal into an electrical comparison signal; conveying said comparison signals along a second path, at least a portion of one of said paths being common to at least a portion of the other of said paths so that drift phenomena, if any, which influence the characteristics of said test signals in each common portion of said paths also influence the characteristics of said comparison signals; deriving from said electrical comparison and test signals derived signals dependent upon the difference between said electrical comparison and test signals, comprising processing said comparison and test signals including detecting the moment at which the test signal reaches an extreme value and at that moment initiating the processing of the test signal; and determining whether the wrappers are defective or non-defective by comparing said derived signals with a reference value.

15. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; conveying said test signals along a first path; generating a pneumatic comparison signal and converting said pneumatic comparison signal into an electrical comparison signal; conveying said comparison signals along a second path, at least a portion of one of said paths being common to at least a portion of the other of said paths so that drift phenomena, if any, which influence the characteristics of said test signals in each common portion of said paths also influence the characteristics of said comparison signals, said generating steps comprising generating said test and comparison signals as the components of a signal flow in which said test and comparison signals form respective distinguishable extreme values; and determining whether the wrappers are defective or non-defective by comparing said derived signals with a reference value.

16. An apparatus for testing the wrappers of cigarettes, cigars, filter rods, analogous rod-shaped smokers' products, components of such articles, and the like, comprising, in combination, measurement transducer means for generating pressure-dependent signals, test pressure generating means for generating test pressures dependent upon the permeability of the wrappers of such articles and applying the test pressure to the measurement transducer means, comparison pressure furnishing means for effecting the application of a comparison pressure to the measurement transducer means, and comparing means for generating a pressure-difference-dependent signal dependent upon the difference between the signals denoting the test and comparison pressures, the test pressures and the respective signals being transmitted to said comparing means along a first path and the comparison pressure and the respective signal being transmitted to said comparing means along a second path, said paths having common portions at least in said transducer means so that drift phenomena, if any, and not ascertained, in each common portion of said paths which influence the characteristics of signals denoting said test pressures also influence the characteristics of signal denoting said comparison pressure and said pressure-difference-dependent signal is uninfluenced by drift phenomena.

17. The apparatus defined in claim 16, further including control means operative for causing the test pressure generating means and the comparison pressure furnishing means to alternately effect the application of test and comparison pressures to the measurement transducer means.

18. The apparatus defined in claim 16, wherein the comparison pressure furnishing means is a structure having a controllable opening leading from the ambient atmosphere to the measurement transducer means.

19. The apparatus defined in claim 16, wherein the measurement transducer means is a pressure-to-voltage converter.

20. The apparatus defined in claim 16, wherein the comparing means constitutes first comparing means, and further including second comparing means having an input connected to the first comparing means for receiving the pressure-difference-dependent signal and operative for generating an output signal dependent upon the difference between the pressure-difference-dependent signal and a predetermined compensation signal, and means for generating and applying the predetermined compensation signal to the second comparing means including averaging means for deriving an average value from the output signals of one of the comparing means.

21. The apparatus defined in claim 20, wherein the means for applying the predetermined compensation signal to the second comparing means includes means for deriving the predetermined compensation signal from the output of the averaging means.

22. The apparatus defined in claim 20, further including signal transmission control means connected between the output of the second comparing means and the input of the averaging means and operative for permitting and preventing transmission of the output signals of the second comparing means to the input of the averaging means in dependence upon the difference between the output signals of the second comparing means and a predetermined reference value.

23. The apparatus defined in claim 20, further including means operative for receiving the predetermined compensation signal and comparing it against a reference value and generating defect signals in dependence upon that comparison.

24. The apparatus defined in claim 20, wherein the means for generating and applying the predetermined compensation signal to the second comparing means further includes adjustable signal generating means operative for generating a persisting output signal.

25. The apparatus defined in claim 24, wherein the means for generating and applying the predetermined compensation signal to the second comparing means further includes evaluating means connected to the output of the averaging means for evaluating the output signal of the averaging means and adjusting means connected to the output of the evaluating means and to the adjustable signal generating means for automatically adjusting the latter in dependence upon the output signal of the evaluating means.

26. The apparatus defined in claim 20, and further including time-delay means connecting the output of the first comparing means to the input of the second comparing means for transmitting to the latter the pressure-difference-dependent signal with a predetermined time delay.

27. Apparatus for testing the wrappers of cigarettes, cigars, filter rods, analogous rod-shaped smokers' products, components of such articles and the like, comprising measurement transducer means for generating pressure-dependent signals; test pressure generating means for generating test pressures dependent upon the permeability of the wrappers of such articles and applying said test pressures to said transducer means; comparison pressure furnishing means for effecting the application of a comparison pressure to said transducer means; control means operative for causing said test pressure generating means and said comparison pressure furnishing means to alternately effect the application of test and comparison pressures to said transducer means to cause the latter to generate a signal flow in which test and comparison signals form extreme values; extreme-value-detecting means connected to said transducer means to receive the signal flow and operative for detecting when one of the signals in the signal flow reaches an extreme value; comparing means for generating a pressure-difference-dependent signal dependent upon the difference between the signals denoting the test and comparison pressures, the test pressures and the respective signals being transmitted to said comparing means along a first path and the comparison pressure and the respective signal being transmitted to said comparing means along a second path, said paths having common portions at least in said transducer means so that drift phenomena, if any, in each common portion of said paths which influence the characteristics of signals denoting said test pressures also influence the characteristics of signal denoting said comparison pressure; and signal transfer means connected to said extreme-value-detecting means and to said transducer means and operative in response to the extreme-value-detection for transmitting to said comparing means the signal reaching the detected extreme value.

28. The apparatus defined in claim 27, wherein the extreme-value-detecting means comprises differentiating means for differentiating the signal flow and threshold-detecting means for determining when the differentiated signal flow reaches a value corresponding to the extreme value of a signal in the undifferentiated signal flow.

29. Apparatus for testing the wrappers of cigarettes, cigars, filter rods, analogous rod-shaped smokers' products, components of such articles and the like, comprising measurement transducer means for generating pressure-dependent signals; test pressure generating means for generating test pressures dependent upon the permeability of the wrappers of such articles and applying said test pressures to said transducer means; comparison pressure furnishing means for effecting the application of a comparison pressure to said transducer means; control means operative for causing said test pressure generating means and said comparison pressure furnishing means to alternately effect the application of test and comparison pressures to said transducer means to cause the latter to generate a signal flow in which test and comparison signals form extreme values; extreme-value-detecting means connected to said transducer means to receive the signal flow and operative for detecting when the comparison signal reaches an extreme value; comparing means for generating a pressure-difference-dependent signal dependent upon the difference between the signals denoting the test and comparison pressures, the test pressures and the respective signals being transmitted to said comparing means along a first path and the comparison pressure and the respective signal being transmitted to said comparing means along a second path, said paths having common portions at least in said transducer means so that drift phenomena, if any, in each common portion of said paths which influence the characteristics of signals denoting said test pressures also influence the characteristics of signal denoting said comparison pressure; and signal transfer means connected to said extreme-value-detecting means and to said transducer means and operative in response to the extreme-value detection for transmitting to said comparing means the comparison signal as it reaches the detected extreme value.

30. Apparatus for testing the wrappers of cigarettes, cigars, filter rods, analogous rod-shaped smokers' products, components of such articles and the like, comprising measurement transducer means for generating pressure-dependent signals; test pressure generating means for generating test pressures dependent upon the permeability of the wrappers of such articles and applying said test pressures to said transducer means; comparison pressure furnishing means for effecting the application of a comparison pressure to said transducer means; control means operative for causing said test pressure generating means and said comparison pressure furnishing means to alternately effect the application of test and comparison pressures to said transducer means to cause the latter to generate a signal flow in which test and comparison pressures form extreme values; extreme-value-detecting means connected to said transducer means to receive the signal flow and operative for detecting when the test signal reaches an extreme value; comparing means for generating a pressure-difference-dependent signal dependent upon the difference between the signals denoting the test and comparison pressures, the test pressures and the respective signals being transmitted to said comparing means along a first path and the comparison pressure and the respective signal being transmitted to said comparing means along a second path, said paths having common portions at least in said transducer means so that drift phenomena, if any, in each common portion of said paths which influence the characteristics of signals denoting said test pressures also influence the characteristics of signal denoting said comparison pressure; and signal transfer means connected to said extreme-value-detecting means and said transducer means and operative in response to the extreme-value-detection for transmitting to said comparing means the test signal as it reaches the detected extreme value.

31. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; generating a pneumatic comparison signal and converting said pneumatic comparison signal into an electrical comparison signal, said generating steps including generating said test and comparison signals as the components of a signal flow in which test and comparison signals form extreme values; deriving from said electrical comparison and test signals derived signals dependent upon the difference between said electrical comparison and test signals, comprising processing said comparison and test signals including detecting the moment at which one of the signals reaches an extreme value and at the moment initiating the processing of the one signal; and determining whether the wrappers are defective or non-defective by comparing said derived signals with a reference value.

32. The method of claim 31, wherein the detecing of the moment at which one of the signals reaches an extreme value comprises forming the first time derivative of the signal flow and detecting the moment at which the first time derivative reaches a predetermined value.

33. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; generating a pneumatic comparison signal and converting said pneumatic comparison signal into an electrical comparison signal; deriving from said electrical comparison and test signals derived signals dependent upon the difference between said electrical comparison and test signals, comprising processing said comparison and test signals including detecting the moment at which the comparison signal reaches an extreme value and at that moment initiating the processing of the comparison signal; and determining whether the wrappers are defective or non-defective by comparing said derived signals with a reference value.

34. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; generating a pneumatic comparison signal and converting said pneumatic comparison signal into an electrical comparison signal; deriving from said electrical comparison and test signals derived signals dependent upon the difference between said electrical comparison and test signals, comprising processing said comparison and test signals including detecting the moment at which the test signal reaches an extreme value and at the moment initiating the processing of the test signal; and determining whether the wrappers are defective or non-defective by comparing said derived signals with a reference value.

35. A method of testing the wrappers of cigarettes, cigars, filter rods, analogous rod-shaped smokers' products, components thereof and the like, comprising the steps of generating pneumatic test signals indicative of the extent to which imperfections are present in the wrappers of such rod-shaped articles and converting said pneumatic test signals into electrical test signals; generating a pneumatic comparison signal and converting said pneumatic comparison signal into an electrical comparison signal, said generating steps comprising generating said test and comparison signals as the components of a signal flow in which said test and comparison signals form respective distinguishable extreme values; and determining whether the wrappers are defective or non-defective by comparing said derived signals with a reference value.

36. Apparatus for testing the wrappers of cigarettes, cigars, filter rods, analogous rod-shaped smokers' products, components of such articles and the like, comprising measurement transducer means for generating pressure-dependent signals; test pressure generating means for generating test pressures dependent upon the permeability of the wrappers of such articles and applying said test pressures to said transducer means; comparison pressure furnishing means for effecting the application of a comparison pressure to said transducer means; control means operative for causing said test pressure generating means and said comparison pressure furnishing means to alternately effect the application of test and comparison pressures to said transducer means to cause the latter to generate a signal flow in which test and comparison signals form extreme values; extreme-value-detecting means connected to said transducer means to receive the signal flow and operative for detecting when one of the signals in the signal flow reaches an extreme value; comparing means for generating a pressure-difference-dependent signal dependent upon the difference between said test and comparison pressures; and signal transfer means connected to said extreme-value-detecting means and to said transducer means and operative in response to the extreme-value-detection for transmitting to said comparing means the signal reaching the detected extreme value.

37. The apparatus of claim 36, wherein said extreme-value-detecting means comprises differentiating means for differentiating the signal flow and threshold-detecting means for determining when the differentiated signal flow reaches a value corresponding to the extreme value of a signal in the undifferentiated signal flow.

38. Apparatus for testing the wrappers of cigarettes, cigars, filter rods, analogous rod-shaped smokers' products, components of such articles and the like, comprising measurement transducer means for generating pressure-dependent signals; test pressure generating means for generating test pressures dependent upon the permeability of the wrappers of such articles and applying said test pressures to said transducer means; comparison pressure furnishing means for effecting the application of a comparison pressure to said transducer means; control means operative for causing said test pressure generating means and said comparison pressure furnishing means to alternately effect the application of test and comparison pressures to said transducer means to cause the latter to generate a signal flow in which test and comparison signals form extreme values; extreme-value-detecting means connected to said transducer means to receive the signal flow and operative for detecting when the comparison signal reaches an extreme value; comparing means for generating a pressure-difference-dependent signal dependent upon the difference between said test and comparison pressures; and signal transfer means connected to said extreme-value-detecting means and to said transducer means and operative in response to the extreme-value detection for transmitting to said comparing means the comparison signal as it reaches the detected extreme value.

39. Apparatus for testing the wrappers of cigarettes, cigars, filter rods, analogous rod-shaped smokers' products, components of such articles and the like, comprising measurement transducer means for generating pressure-dependent signals; test pressure generating means for generating test pressures dependent upon the permeability of the wrappers of such articles and applying said test pressures to said transducer means; comparison pressure furnishing means for effecting the application of a comparison pressure to said transducer means; control means operative for causing said test pressure generating means and said comparison pressure furnishing means to alternately effect the application of test and comparison pressures to said transducer means to cause the latter to generate a signal flow in which test and comparison signals form extreme values; extreme-value-detecting means connected to said transducer means to receive the signal flow and operative for detecting when the test signal reaches an extreme value; comparing means for generating a pressure-difference-dependent signal dependent upon the difference between said test and comparison pressures; and signal transfer means connected to said extreme-value-detecting means and said transducer means and operative in response to the extreme-value-detection for transmitting to said comparing means the test signal as it reaches the detected extreme value.

* * * * *